US007549192B2

(12) United States Patent
Cude

(10) Patent No.: US 7,549,192 B2
(45) Date of Patent: Jun. 23, 2009

(54) HANDLE AND METHOD OF MANUFACTURE

(75) Inventor: J. Michael Cude, Woodburn, KY (US)

(73) Assignee: Coeur, Inc., Lebanon, TN (US)

( * ) Notice: Subject to any disclaimer, the term of this patent is extended or adjusted under 35 U.S.C. 154(b) by 265 days.

(21) Appl. No.: 11/306,957

(22) Filed: Jan. 17, 2006

(65) Prior Publication Data

US 2007/0163079 A1 Jul. 19, 2007

(51) Int. Cl.
*B65D 25/00* (2006.01)

(52) U.S. Cl. ..... 16/114.1; 16/444

(58) Field of Classification Search ..... 16/114.1, 16/410, 430

See application file for complete search history.

(56) References Cited

U.S. PATENT DOCUMENTS

| | | | | | |
|---|---|---|---|---|---|
| 2,329,767 | A * | 9/1943 | Jakeway | 16/419 |
| 2,345,371 | A * | 3/1944 | Amrine | 16/444 |
| 2,397,306 | A * | 3/1946 | Whipple | 455/157.1 |
| 2,913,080 | A * | 11/1959 | Louik et al. | 16/408 |
| 3,224,412 | A * | 12/1965 | Fuentes, Jr. | 119/851 |
| 3,269,495 | A * | 8/1966 | Bush | 16/114.1 |
| 3,531,822 | A * | 10/1970 | Bush | 16/409 |
| 3,737,944 | A * | 6/1973 | Szabo et al. | 16/430 |
| 3,813,729 | A * | 6/1974 | Szabo et al. | 16/408 |
| 3,905,249 | A * | 9/1975 | Murvall | 74/543 |
| 4,091,497 | A * | 5/1978 | Bade | 16/430 |
| 4,260,207 | A * | 4/1981 | Herron et al. | 312/208.6 |
| 4,280,247 | A * | 7/1981 | Burzen et al. | 16/409 |
| 4,364,150 | A * | 12/1982 | Remington | 16/409 |
| 4,609,315 | A * | 9/1986 | Briles | 411/43 |
| 4,785,495 | A * | 11/1988 | Dellis | 16/421 |
| 5,303,451 | A * | 4/1994 | Graviss et al. | 16/412 |
| 5,317,795 | A * | 6/1994 | Bolton et al. | 29/434 |
| 5,328,388 | A * | 7/1994 | Fust et al. | 439/544 |
| 5,781,956 | A * | 7/1998 | Kelsay et al. | 15/143.1 |
| 5,947,667 | A * | 9/1999 | Cassatt et al. | 411/34 |
| 6,119,309 | A * | 9/2000 | Lu | 16/114.1 |
| 6,131,972 | A * | 10/2000 | Whitehead et al. | 294/57 |
| 6,588,113 | B2 * | 7/2003 | Bozikis et al. | 30/526 |
| 6,640,378 | B2 * | 11/2003 | Hsu | 15/235.4 |
| 2002/0070552 | A1 * | 6/2002 | Higuchi et al. | 290/1 A |
| 2004/0231941 | A1 * | 11/2004 | Van Hoye et al. | 190/124 |

* cited by examiner

*Primary Examiner*—Victor Batson
*Assistant Examiner*—Roberta Delisle
(74) *Attorney, Agent, or Firm*—Hahn Loeser & Parks, LLP; Timothy D. Smith

(57) ABSTRACT

A molded heavy-duty ergonomic handle comprises: a top portion, the top portion extending in a longitudinal direction and being substantially smooth; and at least one U-shaped side channel having a plurality of ribs therein, the at least one channel having substantially smooth exterior surfaces and being located on a longitudinal side of the top portion.

11 Claims, 5 Drawing Sheets

HANDLE AND METHOD OF MANUFACTURE

FIELD OF THE INVENTION

The present invention relates generally to molded handles. Specifically, it relates to an injection molded handle that efficiently uses material and is structurally sound, easier to produce, and is ergonomic, meaning it has a generally smooth lower surface, free from exposed ribs that provide discomfort to a user thereof when lifting heavier loads or any load for an extended period of time.

BACKGROUND

Prior art injection molded handles, for example on sewing machine covers, generally contain smooth top surfaces and oversized ribs along the underside. The smooth top surfaces provide a visually pleasing design. The oversized ribs provide additional strength necessary for proper handle operation. However, locating the ribs on the underside creates discomfort for users when carrying heavier loads, or even lighter loads for an extended period of time. Further, the ribs must be oversized, because the use of ribs as strengthening members on the lower portion of the handle is inefficient under bending loads. In an attempt to maintain the molding costs, prior art designs have been unable to eliminate the use of ribs on the underside without sacrificing strength or using more complicated molds, which may use cams and slides. Still further, other design features are necessitated in part by the molding process, such as providing a smooth top surface to provide a convenient and cost-effective location for injection mold gates. Consequently, it is desirable to have a design that efficiently uses material to provide a structurally sound and ergonomic molded handle that is easy to produce.

SUMMARY OF THE INVENTION

In one embodiment of the present invention, a molded heavy-duty ergonomic handle comprises: a top portion, the top portion extending in a longitudinal direction and being substantially smooth; and at least one U-shaped side channel having a plurality of ribs therein, the at least one channel having substantially smooth exterior surfaces and being located on a longitudinal side of the top portion.

In another embodiment of the present invention, a handled cover comprises: a handle, the handle having two opposing ends and comprising: a top member, the top member extending in a longitudinal direction between the two opposing ends and having a smooth top surface; and at least one U-shaped side channel having a plurality of ribs therein, the at least one channel having substantially smooth exterior surfaces and being located on a longitudinal side of the top portion; a first and a second base, each base being adjacent to one of the opposing ends of the handle; and a cover, the cover being adjacent to the first and second bases.

DETAILED DESCRIPTION OF THE PREFERRED EMBODIMENTS

Figure 1:
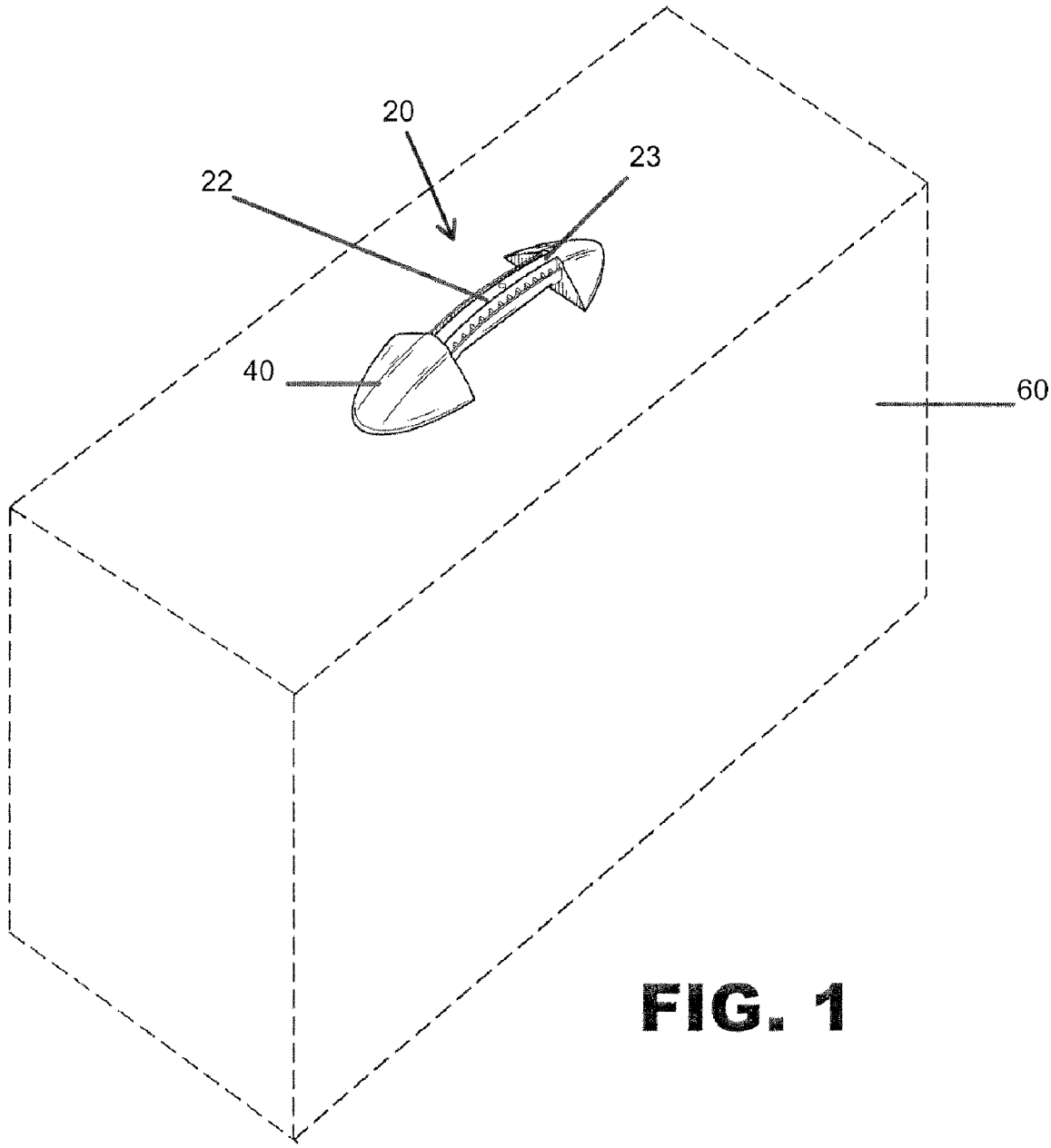
FIG. 1 is a perspective view of an object with a molded ergonomic handle of the present invention.
Figure 2:
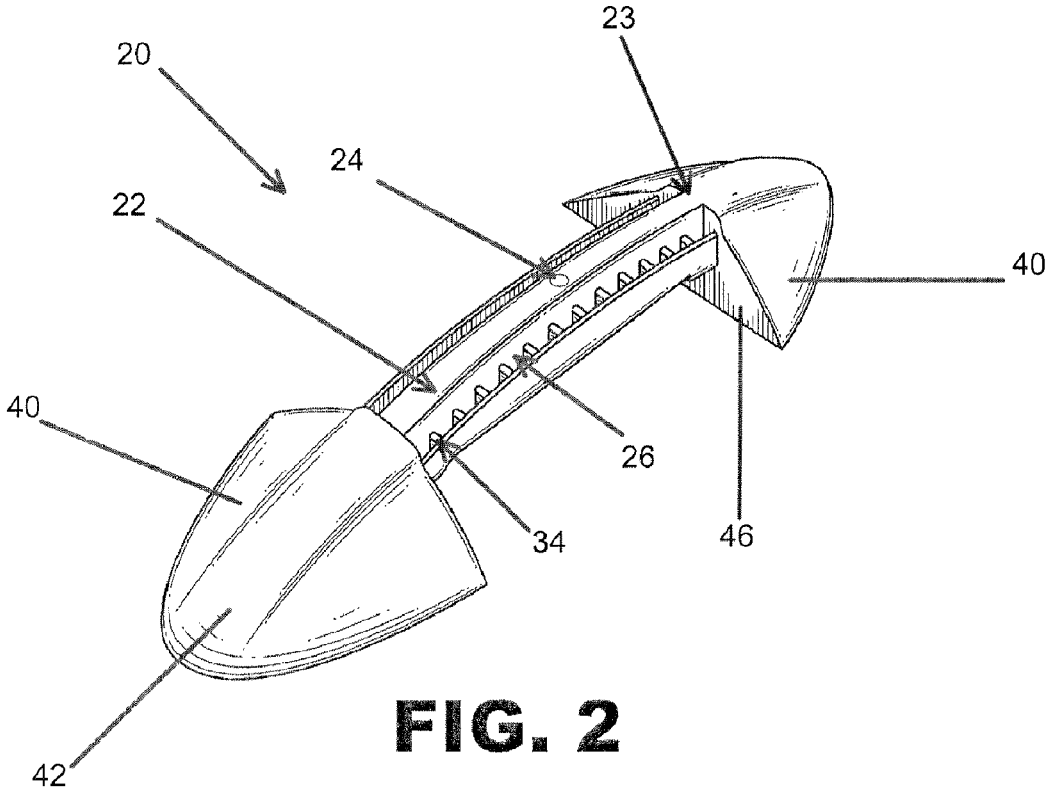
FIG. 2. is a perspective view of the molded ergonomic handle of FIG. 1.
Figure 3:
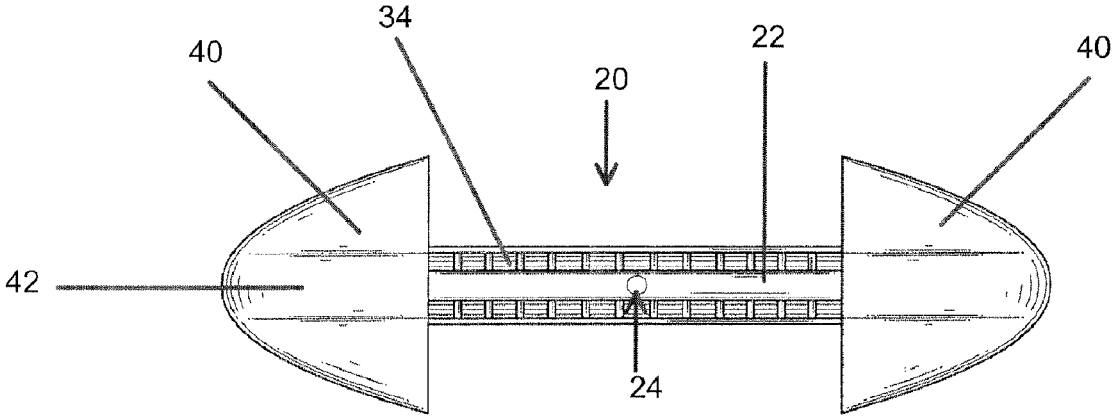
FIG. 3. is a top view of the molded ergonomic handle of FIG. 1.
Figure 4:
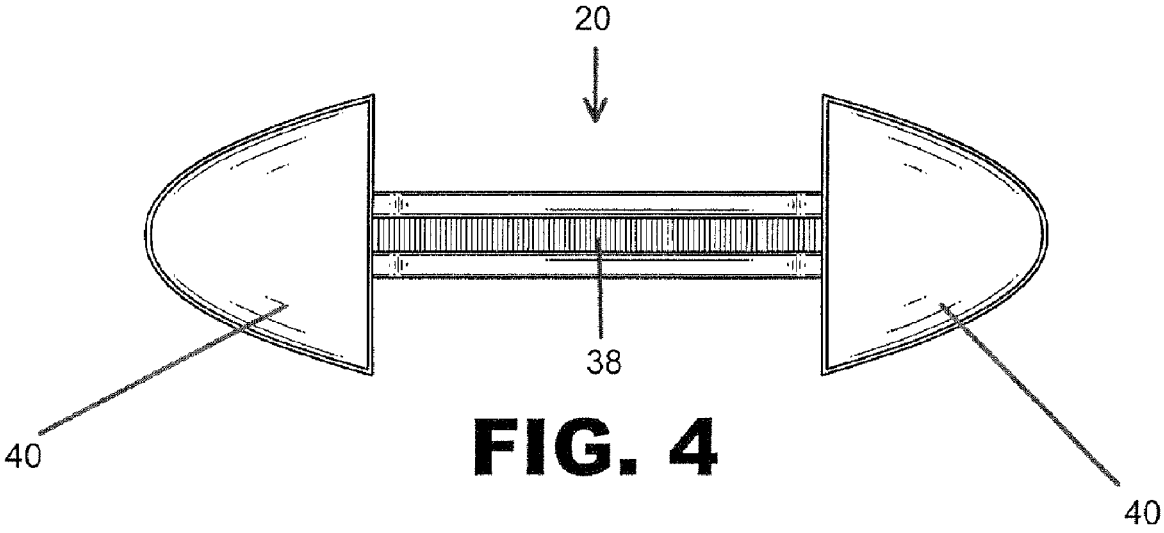
FIG. 4. is a bottom view of the molded ergonomic handle of FIG. 1.
Figure 5:
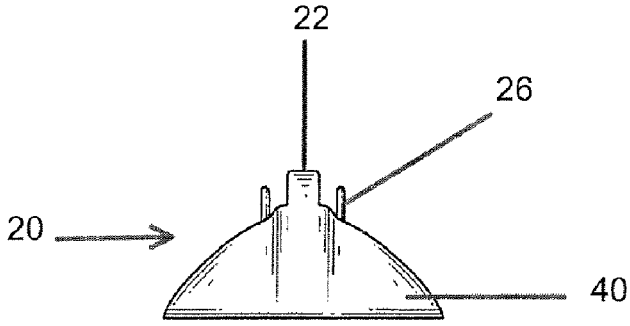
FIG. 5. is an end view of the molded ergonomic handle of FIG. 1.
Figure 6:
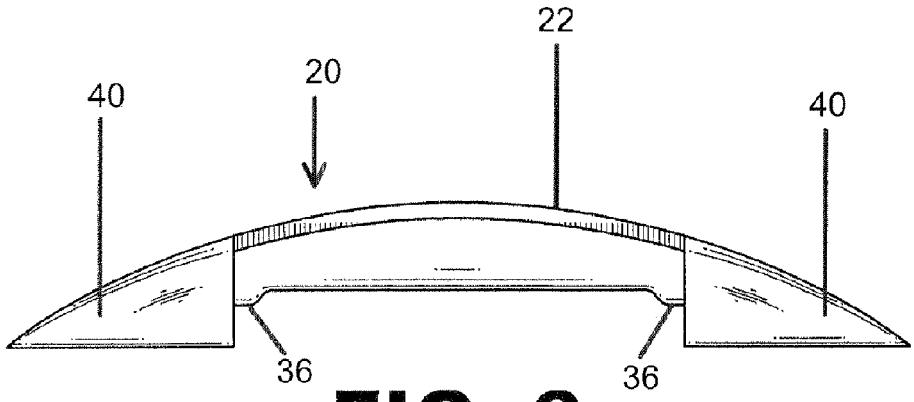
FIG. 6. is a side view of the molded ergonomic handle of FIG. 1.

Referring to FIGS. 1-6, a molded ergonomic handle 20 is shown, the design of which efficiently imparts needed strength while providing an ergonomic underside and facilitating simple production thereof. Handle 20 generally comprises top portion 22, side channels 26, and ribs 34, which are located within channels 26. Handle 20 ultimately attaches to or is formed integrally (where all parts are maintained in a fixed relationship as a single unit) or monolithically (as a single uniform unit) with an intended object 60, such as a sewing machine cover (shown), a tool box lid, a bowling ball bag, a piece of luggage, a tote, a briefcase, etc. In another aspect, the invention according to the present invention may comprise an injection mold having a mold cavity that is complementary to the shape of the handle 20 or handle 20 plus object 60. Additionally, the invention may encompass a method of molding handle 20.

Top portion 22 extends lengthwise (longitudinally) along the top of elongated handle 20 from either end 23 thereof. Generally, the lengthwise extension of portion 22 is smooth, or, in other words, devoid of any abrupt directional changes along the lengthwise extension that may significantly harm material flow during the molding process. Top portion 22 may be arc-like. Consequently, this top portion 22 provides a convenient and efficient location to place adjacently thereto within the mold a gate, which allows material to be injected into the mold cavity and is evidenced by surface irregularity 24, since the smooth contour of the extension promotes material flow into the mold cavity.

Side channels 26 may be located on either side of top portion 22, and may be generally U-shaped, comprising side walls 28, 30 and bottom 32. Side wall 28 extends down from top member 22 to bottom 32, while side wall 30 extends up from bottom 32. The U-shape efficiently provides strength, by having the bottom 32 extend laterally in a plane furthest from the neutral axis, to resist any bending moment generated from loads acting on ends 23. Also, the U-shape is ergonomically pleasing, as side wall 28 and bottom 32 have substantially smooth exterior surfaces, thereby providing ample surface area to comfortably support a user's hand when under load. This is contrary to prior art injection molded handles (not hollow or solid) that include ribs along the bottom surface, which provide limited and discontinuous surface area and cause the user discomfort as the ribs provide local areas of high pressure upon the user's hand. Ribs 34 may be included within channels 26, generally extending between walls 28, 30 as strengthening members. Finally, channels 26 may include an expanded portion 36 at either end 23 to provide added strength and reduce concentrated stresses at the junction between ends 28, 30 and bases 40 or an intended object 60.

Figure 7:
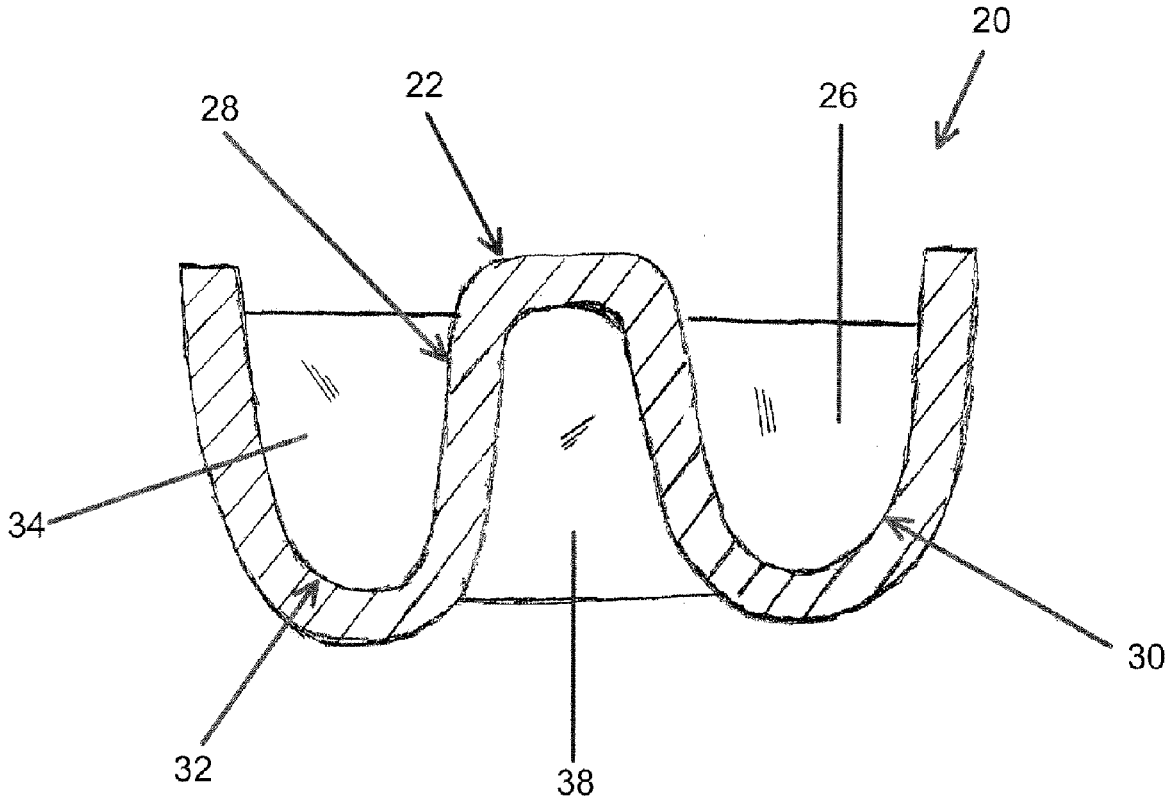
FIG. 7 is a cross-sectional view through the middle of an embodiment of a molded ergonomic handle.
Figure 8:
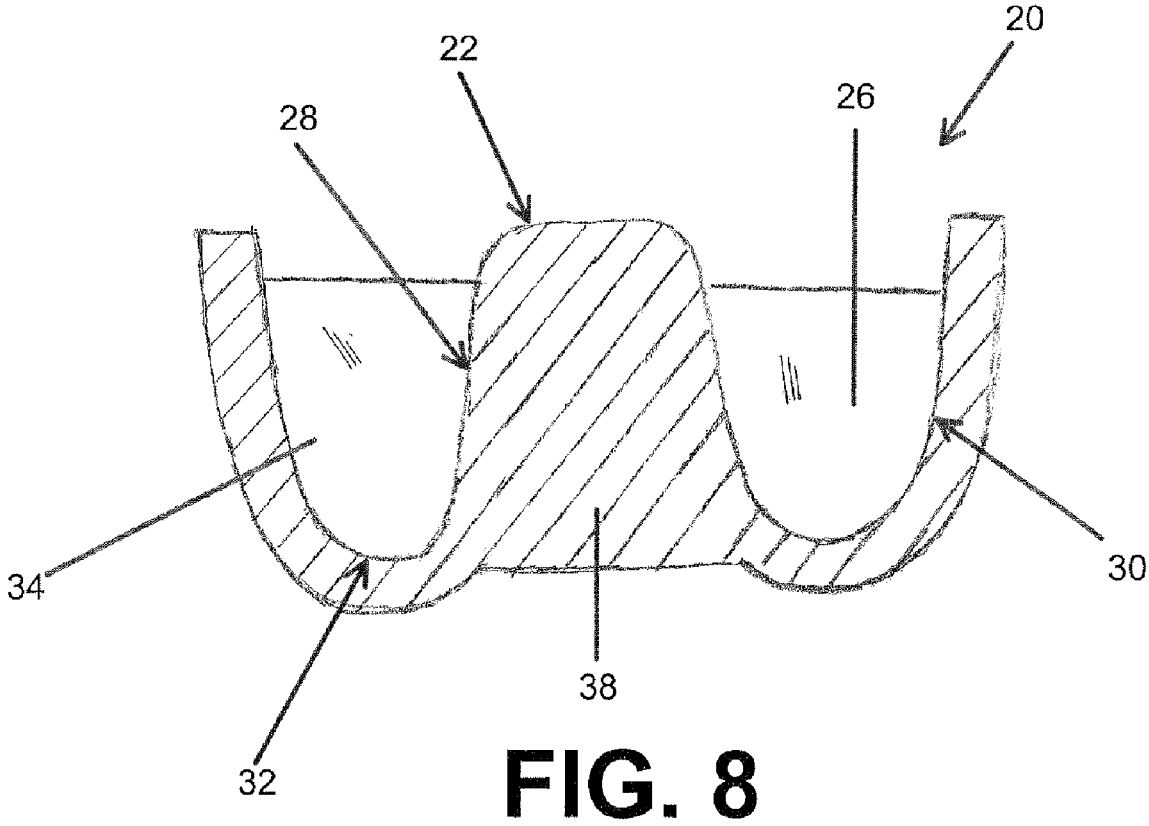
FIG. 8 is a cross-sectional view through the middle of an embodiment of a molded ergonomic handle having web continuous with the top portion and internal sides of the side channels.

Handle 20 may also optionally include web 38, located below top portion 22 and between side walls 28. The web 38 may be a series of discrete ribs or the like, as seen in FIG. 7. Alternatively, the web 38 may simply form a continuous longitudinally-extending main member with both side walls 28, top portion 22, and web 38, as illustrated in FIG. 8. Alternatively, the main member may encompass only a portion of both side walls 28, such that the web 38 does not extend completely to bottom 32.

Handle 20 may be attached to any intended object 60 directly or indirectly, for example through the use of bases 40. Bases 40 allow handle 20 to mount away from object 60 to provide clearance for a user's fingers, thereby allowing the user to properly grasp handle 20. Base 40 may comprise a raised area 42 and a mounting surface 46. A contour may extend from raised area 42, which allows for a larger mounting surface 46 without requiring a larger raised area 42.

Handle 20 may exist independently, or may be integral or monolithic with base 40 and/or object 60. If handle exists independently, handle 20, base 40, and/or object 60 may be joined by any commercially known means, such as by welds, fasteners, or mechanical interference. If handle 20 does not exist independently, handle 20, base 40, and/or object 60 may be formed as a unitary piece by any commercially known method, such as by injection molding. Generally, handle 20, and base 40 and object 60, if integral or monolithic with handle 20, may be made form any commercially known moldable material, such as thermoplastics and metals.

The present invention allows molding of the entire handle 20 and any associated monolithic objects 60 via a single gate. As best seen in FIG. 7, the cross-sectional area of handle 20, including top portion 22, left side walls 28, 30, and bottom 32, and right side walls 28, 30 and bottom 32 all provide increased volume for the molten plastic to traverse over conventional handles and mold designs. Additionally, the handle 20 provides the necessary strength due to the inclusion of ribs 34. Finally, the handle 20 enables efficient molding, as no slides and/or complex molding equipment and procedures are needed.

Although the invention has been described herein with reference to the present embodiments, it will become apparent to those skilled in the art that various modifications of the present embodiments of the invention as described herein can be made without departing from the spirit or scope of the invention as defined by the appended claims.

What is claimed is:

1. A molded ergonomic handle, comprising:

a longitudinally-extending top portion; and, at least two spaced apart longitudinally-extending U-shaped in cross-section side channels separated by the top portion that is U-shaped and defines a concave region that includes a transversely extending web, the at least two longitudinally-extending U-shaped side channels having a plurality of reinforcing ribs that extend transversely across the width of the U-shaped side channels;

wherein the at least two spaced apart longitudinally-extending U-shaped side channels are diametrically disposed on distal sides of the top portion; and, wherein the open end of the U-shaped in cross-section top portion faces in a first direction and the open ends of the at least two spaced apart longitudinally-extending U-shaped side channels face in a second opposite direction.

2. The handle of claim 1, wherein the handle has a longitudinal extent, the web being continuous and extending the entire longitudinal extent of the handle.

3. The handle of claim 2, wherein a portion of the web forms the top surface.

4. The handle of claim 1, wherein the ribs extend transversely across the width of the U-shaped channel.

5. The handle of claim 1, wherein the handle is formed by injection molding.

6. The handle of claim 1, wherein the handle is monolithically formed.

7. An injection-molded handle, comprising:

a longitudinally-extending main member having a U-shaped cross-section longitudinally extending along its length;

two longitudinally-extending side channels each having a generally U-shaped cross-section co-extending longitudinally along the length of the longitudinally-extending main member and attached to distal sides of the main member; wherein, the side channels include a plurality of transverse reinforcing ribs that provide strength to the handle; and, wherein an open side defined by the longitudinally extending U-shaped cross-section of the longitudinally-extending main member faces diametrically away from open sides of the side channels, each open side defined by the longitudinally extending generally U-shaped cross-section of the respective side channel.

8. A method of injection-molding the handle of claim 7, comprising: providing an injection mold having a mold cavity having at least a portion complementary to the handle of claim 7; providing an injection gate on the top portion of the main member; and, injecting molten polymer into the mold.

9. The method of claim 8, wherein the mold comprises one and only one gate.

10. The handle of claim 7, wherein the handle is monolithic with a cover.

11. The handle of claim 7, further comprising a web extending between the U-shaped side channels, the web being vertically spaced from the main member.

* * * * *